US008122732B2

(12) United States Patent
Lee et al.

(10) Patent No.: US 8,122,732 B2
(45) Date of Patent: Feb. 28, 2012

(54) REFRIGERATOR WITH NOISE REDUCTION STRUCTURE USING INVERSE PHASE SOUND WAVE

(75) Inventors: Joon Keun Lee, Seoul (KR); Jeong Ho Kim, Gyeonggi-do (KR); Won Ki Park, Gyeonggi-do (KR)

(73) Assignee: LG Electronics Inc., Seoul (KR)

( * ) Notice: Subject to any disclaimer, the term of this patent is extended or adjusted under 35 U.S.C. 154(b) by 543 days.

(21) Appl. No.: 12/440,358

(22) PCT Filed: Sep. 7, 2007

(86) PCT No.: PCT/KR2007/004334

§ 371 (c)(1),
(2), (4) Date: Mar. 6, 2009

(87) PCT Pub. No.: WO2008/030060

PCT Pub. Date: Mar. 13, 2008

(65) Prior Publication Data

US 2010/0175410 A1 Jul. 15, 2010

(30) Foreign Application Priority Data

Sep. 7, 2006 (KR) ..... 10-2006-0086086

(51) Int. Cl.
*F25D 19/00* (2006.01)
*F01N 1/06* (2006.01)
*F16F 7/00* (2006.01)

(52) U.S. Cl. ..... 62/296; 181/206; 181/207

(58) Field of Classification Search ..... 62/296, 62/115, 160, 324.6, 527; 181/206, 207
See application file for complete search history.

(56) References Cited

FOREIGN PATENT DOCUMENTS

| | | |
|---|---|---|
| JP | 2005-233455 | 9/2005 |
| KR | 10-2000-0044073 | 7/2000 |
| KR | 10-2005-0026595 | 3/2005 |
| KR | 10-2006-0087227 | 8/2006 |

*Primary Examiner* — Chen Wen Jiang
(74) *Attorney, Agent, or Firm* — Ked & Associates LLP

(57) ABSTRACT

Disclosed is a refrigerator having a noise reduction structure. According to the refrigerator, a branch pipe for reducing the intensive noise occurring from an impeller part is provided to a discharge pipe connected so that the refrigerant is discharged in a direction of a condenser from the impeller part. Therefore, the traveling sound wave of the noise traveling along the discharge pipe and the reverse sound wave traveling toward the branch pipe provided to the outer periphery of the discharge pipe meet each other, so that the both sound waves are cancelled to reduce the noise.

3 Claims, 3 Drawing Sheets

[Fig. 1]
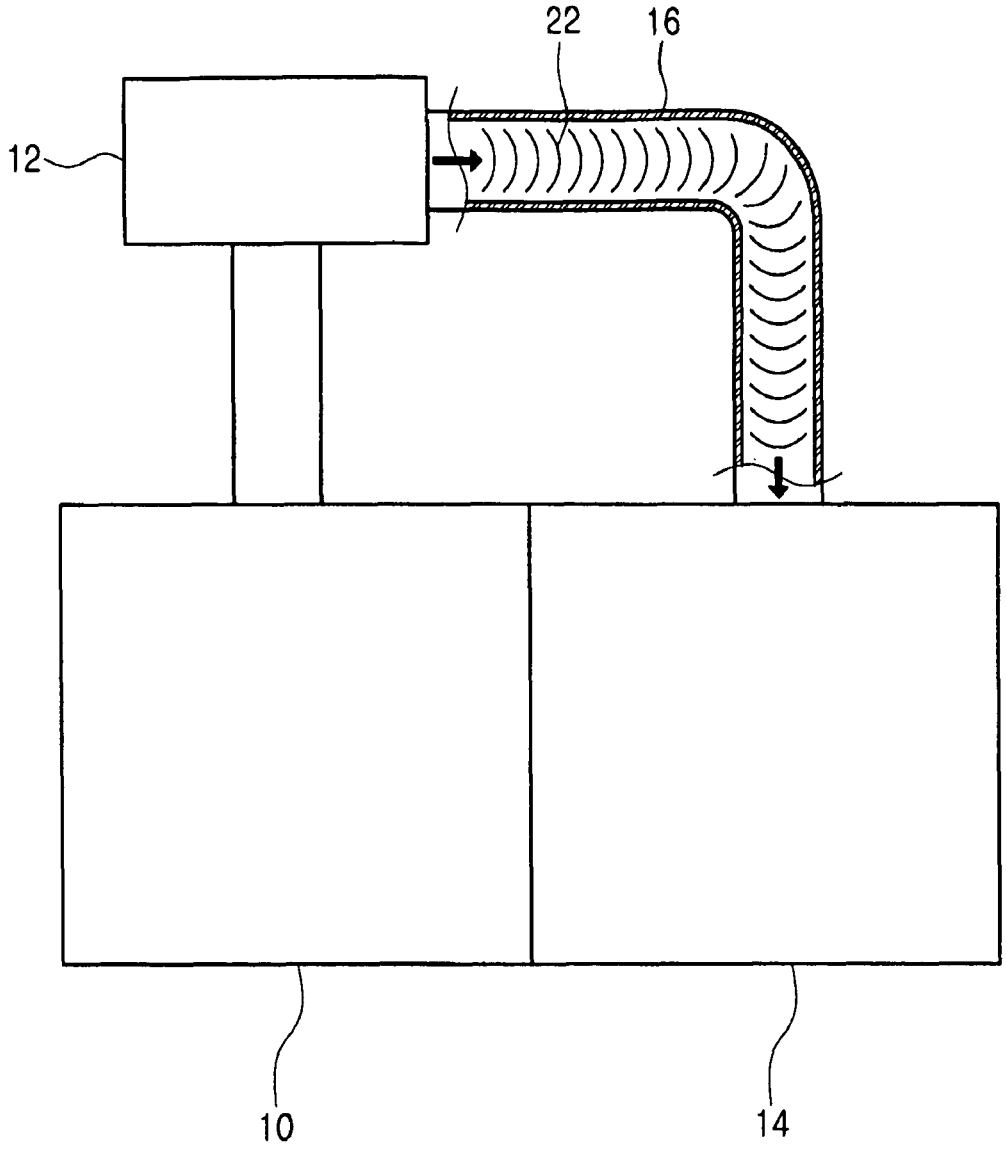

[Fig. 2]
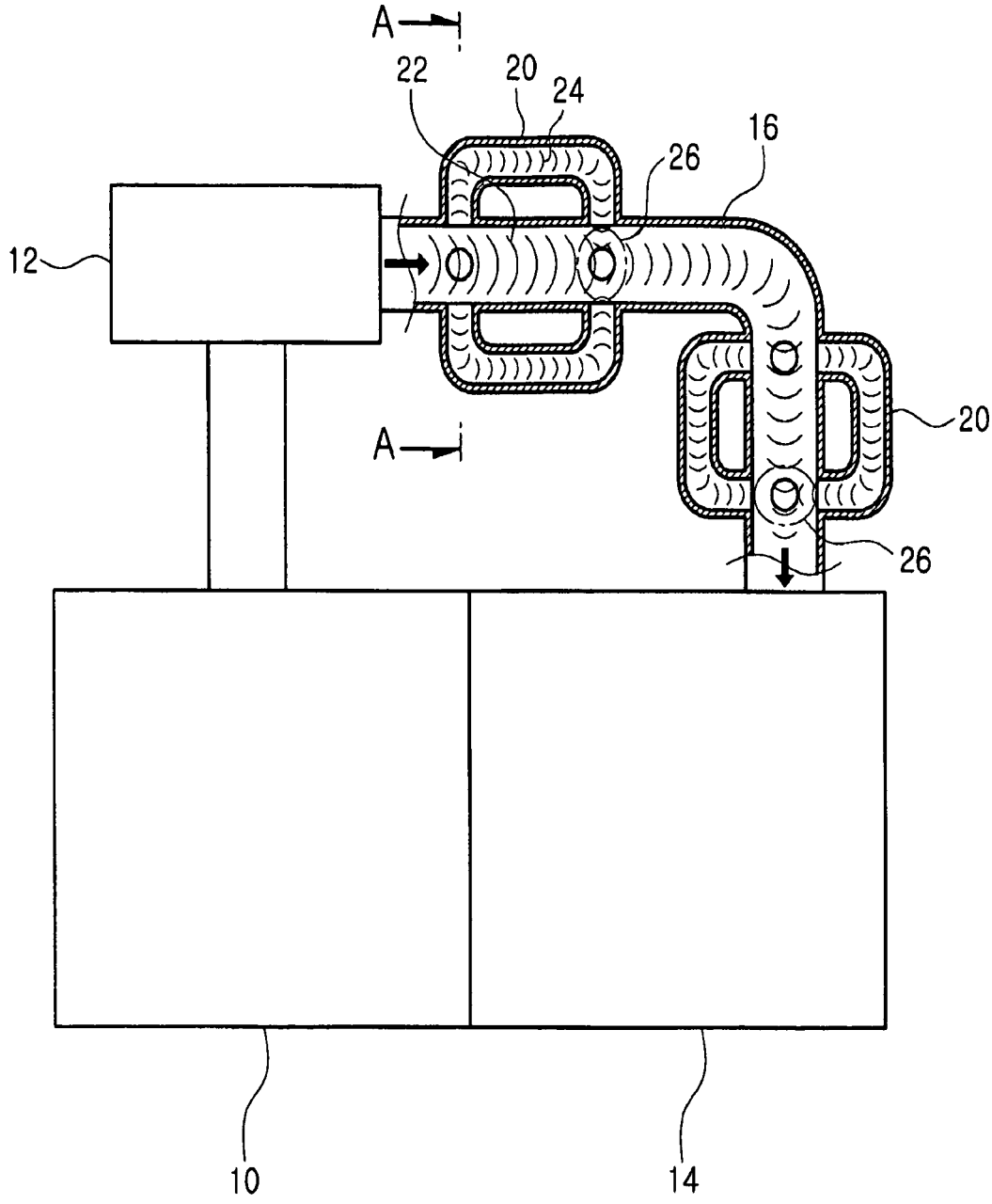

[Fig. 3]
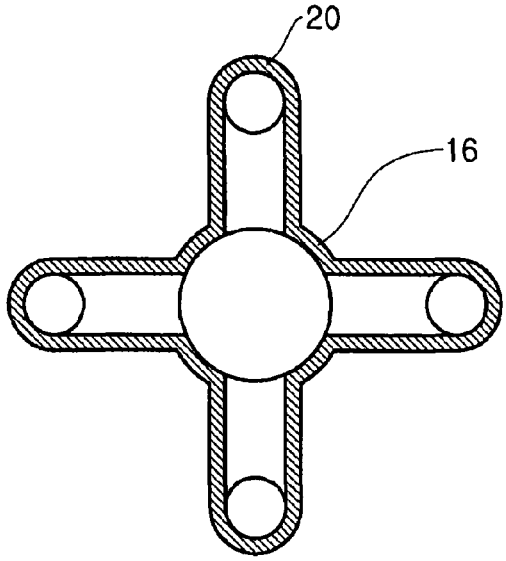
[Fig. 4]
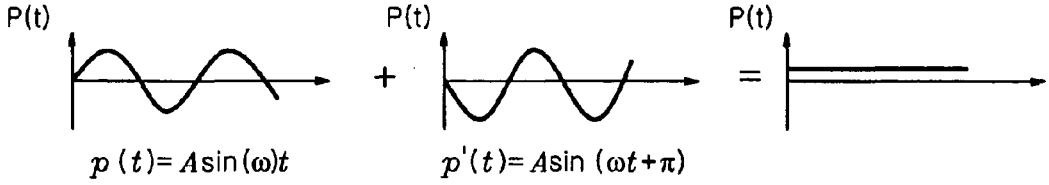

REFRIGERATOR WITH NOISE REDUCTION STRUCTURE USING INVERSE PHASE SOUND WAVE

RELATED APPLICATIONS

This application is the U.S. National Phase under 35 U.S.C. §371 of International Application No. PCT/KR2007/004334, filed on Sept. 7, 2007, which in turn claims the benefit of Korean Patent Application No. 10-2006-0086086, filed on Sept 7, 2006, the disclosures of which Applications are incorporated by reference herein.

TECHNICAL FIELD

The invention relates to a refrigerator having a noise reduction structure, and more particularly, to a refrigerator having a noise reduction structure of a new type wherein a branch pipe is provided to an outer periphery of a discharge pipe so as to reduce the intensive noise occurring from an impeller part, and a traveling sound wave, which travels toward the discharge pipe, and a reverse wave, which travels toward the branch pipe, are thus cancelled at a point at which the two waves meet, thereby reducing the noise.

BACKGROUND ART

As shown in FIG. 1, a refrigerator, which is typically used, comprises an evaporator 10, an impeller part 12 and a condenser 14 and has such a structure that the evaporator 10, the impeller part 12 and the condenser 14 are organically connected to each other to circulate the refrigerant. To be more specific, the refrigerant is transferred from the evaporator 10 to the condenser 14 through a discharge pipe 16 via the impeller part 12 compressing the refrigerant. At this time, a traveling sound wave 22, which is generated while the impeller part 12 compresses and discharges the refrigerant to the discharge pipe 16, is spread along the discharge pipe 16. However, since the discharge pipe 16 has a hollow structure having a constant inner diameter, it is impossible to reduce the traveling sound wave 22 that travels along the discharge pipe 16, which causes the serious noise pollution.

In order to solve the above problem, it has been used a method wherein a separate silencer or resonator is installed in the discharge pipe 16 to cause an acoustic resonance, thereby reducing the noise. According to the conventional method, the silencer or resonator is inserted into the discharge pipe 16 and is then fixed to the discharge pipe 16 using a welding and the like. Therefore, it is not easy to install the noise reduction apparatus. In addition, the acoustic absorption/sound isolation means may be provided to a periphery of the discharge pipe 16 or refrigerator. However, such method increases the related costs.

DISCLOSURE OF INVENTION

Technical Problem

The invention has been made to solve the above problems occurring in the prior art. An object of the invention is to provide a refrigerator having a noise reduction structure, in which a traveling sound wave is branched along a branch pipe to produce a reverse sound wave having an inverse phase and the reverse sound wave is enabled to join with the traveling sound wave, thereby canceling the traveling sound wave.

Another object of the invention is to provide a refrigerator having a noise reduction structure, in which a branch pipe is provided to prevent back pressure from being applied to an inside of a discharge pipe and can be easily installed.

Still another object of the invention is to provide a refrigerator having a noise reduction structure, in which a branch pipe is installed to an outer periphery of a discharge pipe to cancel a traveling sound wave on a surface of the discharge pipe, thereby remarkably reducing the noise to be emitted to an outside.

Technical Solution

In order to achieve the above objects, there is provided a refrigerator having a noise reduction structure comprising an impeller part compressing refrigerant, a condenser condensing the compressed refrigerant and a refrigerant discharge pipe connecting the impeller part and the condenser, wherein the refrigerator further comprises a branch pipe that is provided to an outer periphery of the discharge pipe to bypass the refrigerant flowing in the discharge pipe to an outside in a predetermined section, the traveling sound wave of the refrigerant branched through an end of the branch pipe from the discharge pipe is converted into a reverse sound wave having an inverse phase to the traveling sound wave flowing in the discharge pipe while traveling in the branch pipe, and the reverse sound wave re-joins into the discharge pipe at the other end of the branch pipe and is thus cancelled with the traveling sound wave.

In particular, a diameter of the branch pipe is between 25% and 100% of a wavelength of the traveling sound wave.

In addition, the branch pipe is plurally provided along a longitudinal direction of the discharge pipe.

Further, the branch pipe is plurally provided along a circumferential direction of the outer periphery of the discharge pipe.

ADVANTAGEOUS EFFECTS

According to the invention, the branch pipe for reducing the intensive noise occurring from the impeller part is provided to the discharge pipe connected so that the refrigerant is discharged in a direction of the condenser from the impeller part. Therefore, the traveling sound wave of the noise traveling along the discharge pipe and the reverse sound wave traveling toward the branch pipe meet each other, so that the both sound waves are cancelled to reduce the noise.

In addition, according to the invention, since the branch pipe is provided to the outer periphery of the discharge pipe, the back pressure in the discharge pipe is insignificant. Further, since it is not necessary to fix the branch pipe in the discharge pipe, it is possible to easily equip the branch pipe and to reduce the costs.

In particular, according to the invention, the traveling sound wave on the surface of the discharge pipe is cancelled to considerably reduce the noise to be emitted to the outside through the surface of the discharge pipe.

BRIEF DESCRIPTION OF THE DRAWINGS

The above and other objects, features and advantages of the present invention will be more apparent from the following detailed description taken in conjunction with the accompanying drawings, in which:

FIG. 1 is a schematic sectional view showing a part of the general refrigerator;

FIG. 2 is a schematic longitudinal view showing a noise reduction structure of a refrigerator according to an embodiment of the invention;

FIG. 3 is a sectional view taken along an A-A line of FIGS. 2; and

FIG. 4 is a waveform diagram showing a phenomenon that a traveling sound wave traveling toward a discharge pipe and a reverse sound wave traveling toward a branch pipe meet and are thus cancelled.

MODE FOR THE INVENTION

Hereinafter, a preferred embodiment of the present invention will be described with reference to the accompanying drawings. In the following description of the present invention, a detailed description of known functions and configurations incorporated herein will be omitted when it may make the subject matter of the present invention rather unclear.

FIG. 2 is a schematic longitudinal view showing a noise reduction structure of a refrigerator according to an embodiment of the invention, FIG. 3 is a sectional view taken along a A-A line of FIG. 2 and FIG. 4 is a waveform diagram showing a phenomenon that a traveling sound wave 22 traveling toward a discharge pipe 16 and a reverse sound wave 24 traveling toward a branch pipe 20 meet and are thus cancelled.

As shown in FIG. 2, a refrigerator according to an embodiment of the invention comprises a branch pipe 20 that is formed at an outer periphery of a discharge pipe 16 connecting an impeller part 12 and a condenser 14. The branch pipe 20 is protruded to an outside of the discharge pipe 16 from the outer periphery of the discharge pipe 16. As shown in FIGS. 2 and 3, the discharge pipe 16 and the branch pipe 20 communicate with each other. Therefore, a part of the traveling sound wave 22 traveling along the discharge pipe 16 is branched along the branch pipe 20 and thus bypasses.

To be more specific, while the partial traveling sound wave 22 branched into the branch pipe 20 travels along the branch pipe 20, it becomes a reverse sound wave 24 having an inverse phase to the traveling sound wave 22 flowing along the discharge pipe 16, meets the traveling wave 22 at a cancellation point 26 in the discharge pipe 16 and is thus cancelled.

FIG. 4 is a graph showing a principle of the noise reduction structure of the invention. The reverse sound wave 24 having an inverse phase to the traveling sound wave 22 traveling along the discharge pipe 16 should have a phase difference of $\pi$ (half period) with the traveling sound wave 22. As shown, when it is assumed that a waveform P(t) of the traveling sound wave 22 toward the discharge pipe 16 is $P(t)=A \sin(\omega t)$, a waveform P'(t) of the reverse sound wave 24 having an inverse phase should be $P'(t)=A \sin(\omega t+\pi)$ so that the both sound waves 22, 24 can be cancelled. Here, $\omega$ is an angular velocity and t is time.

Considering the wavelength and phase of the traveling sound wave 22, a length of the branch pipe 20 should be determined so that the sound wave branched from the traveling sound wave 22 has a phase difference of $\pi$ with the traveling sound wave 22. Regarding this, a total length of the branch pipe 20 for forming the reverse sound wave 24 canceling the traveling sound wave 22 is calculated by multiplying the phase velocity and the time.

In general, R-134a of the hydro fluoro carbon (HFC) series, which is the refrigerant used for a refrigerator, has a phase velocity of about 145 m/sec in the discharge pipe 16. If it is assumed that the rotating speed of the impeller part 12 is 14,500 rpm and the number of the outlet blades of the impeller part 12 is 22, the frequency of the traveling sound wave 22 is as follows: f(Hz)=145,000/60×22=5,316 Hz.

Since the inverse phase wave capable of canceling the traveling sound wave 22, i.e., reverse sound wave 24 should have a phase difference of $\pi$ with the traveling sound wave 22, $\omega t$ should be equal to $\pi$ ($\omega t=\pi$) in FIG. 4 and the total length of the branch pipe 20 is C (phase velocity)×t (time). Since $\omega=2\pi f$, $t=9.41\times10^{-5}$. In addition, C=5,316 Hz. Therefore, a part of the traveling sound wave 22 branched into the branch pipe 20 can be the reverse sound wave 24 having an inverse phase when a total length of the branch pipe 20 is 0.0136 m (=13.6 cm).

Like this, the traveling sound wave 22, which travels along the discharge pipe 16, and the reverse sound wave 24, which is branched into the branch pipe 20, join at the cancellation point 26 at which the branch pipe 20 and the discharge pipe 16 meet.

The exemplary length (i.e., 13.6 cm) of the branch pipe 20 is the minimum length of the branch pipe 20 according to the above assumption. When the branch pipe is designed to have a length equal to or larger than the exemplary length, the same noise reduction is effected even when the total length is extended by odd multiples of the exemplary length so as to maintain the inverse phase of the reverse sound wave 24.

In addition, when the sound wave traveling in the branch pipe 20 is not a plane wave, the noise may be increased. Therefore, a diameter of the branch pipe 20 is determined in consideration of the wavelength of the sound wave traveling therein.

In the mean time, when the diameter of the branch pipe 20 is larger than the wavelength ($\lambda$) of the sound wave, a plane wave is not formed in the branch pipe 20. As a result, a phase of the sound wave is different in the diametrical direction of the branch pip 20, so that the noise may be increased. Therefore, a diameter of the branch pipe 20 is preferably designed so that it is smaller than the wavelength ($\lambda$) of the sound wave.

In addition, the velocity of the sound wave is maximized at $\lambda/4$ and $3\lambda/4$ points due to the characteristic of a wave. Accordingly, a diameter of the branch pipe 20 is preferably designed so that it is larger than 25% of the wavelength ($\lambda$) of the sound wave.

As shown in FIG. 2, the branch pipe 20 has a "□" shape in which both ends are connected to the outer periphery of the discharge pipe 16. However, the invention is not limited thereto. For example, the branch pipe 20 may be manufactured to have a length capable of forming the reverse sound wave 24. Further, the branch pipe 20 may be provided in a form of several strands having a smaller diameter, rather than a single thick pipe shape, and may be plurally provided along the longitudinal direction of the discharge pipe 16. In addition, as shown in FIG. 3, the branch pipe 20 may be provided along a circumferential direction of the outer periphery of the discharge pipe 16, thereby canceling the traveling sound wave 22 traveling along the surface of the discharge pipe 16. The noise, i.e., traveling sound wave 22 travels along the surface of the discharge pipe 16 and is a high frequency having a short wavelength. Therefore, the traveling sound wave is difficult to spread to a center of the discharge pipe 16. Thus, since the noise is spread from the surface of the discharge pipe 16, it is possible to efficiently block the noise to be spread from the surface of the discharge pipe 16 when the branch pipe 20 is provided to the outer periphery of the discharge pipe 16.

Moreover, since the branch pipe 20 is protruded to the outside from the outer periphery of the discharge pipe 16, there is no concern that it reduces the internal space of the discharge pipe 16 to apply the back pressure. In addition, the branch pipe 20 can be welded to the outer periphery of the discharge pipe 16, it is easy to equip the branch pipe 20.

INDUSTRIAL APPLICABILITY

The refrigerator of the invention has a noise reduction structure, so that the noise traveling along the discharge pipe can be remarkably reduced.

In addition, in the refrigerator having a noise reduction structure according to the invention, the branch pipe is provided to the outer periphery of the discharge pipe. Therefore, the back pressure is applied in the discharge pipe and the branch pipe can be easily equipped and fixed.

While the invention has been shown and described with reference to certain preferred embodiments thereof, it will be understood by those skilled in the art that various changes in form and details may be made thereto without departing from the spirit and scope of the invention as defined by the appended claims.

The invention claimed is:

1. A refrigerator having a noise reduction structure comprising:

an impeller part 12 compressing refrigerant;

a condenser 14 condensing the compressed refrigerant; and a refrigerant discharge pipe 16 connecting the impeller part 12 and the condenser 14, wherein the refrigerator further comprises a branch pipe 20 that is provided to an outer periphery of the discharge pipe 16 to bypass the refrigerant flowing in the discharge pipe 16 to an outside in a predetermined section, wherein a traveling sound wave 22 of the refrigerant branched through an end of the branch pipe 20 from the discharge pipe 16 is converted into a reverse sound wave 24 having an inverse phase to the traveling sound wave 22 flowing in the discharge pipe 16 while traveling in the branch pipe 20, and wherein the reverse sound wave 24 re-joins into the discharge pipe 16 at the other end of the branch pipe 20 and is thus cancelled with the traveling sound wave 22, and wherein a diameter of the branch pipe 20 is between 25% and 100% of a wavelength of the travelling sound wave 22.

2. The refrigerator according to claim 1, wherein the branch pipe 20 is plurally provided along a longitudinal direction of the discharge pipe 16.

3. The refrigerator according to claim 1, wherein the branch pipe 20 is plurally provided along a circumferential direction of the outer periphery of the discharge pipe 16.

* * * * *